US007826625B2

(12) United States Patent
Lashkari

(10) Patent No.: US 7,826,625 B2
(45) Date of Patent: Nov. 2, 2010

(54) METHOD AND APPARATUS FOR FRAME-BASED LOUDSPEAKER EQUALIZATION

(75) Inventor: Khosrow Lashkari, Hayward, CA (US)

(73) Assignee: NTT DoCoMo, Inc., Tokyo (JP)

( * ) Notice: Subject to any disclaimer, the term of this patent is extended or adjusted under 35 U.S.C. 154(b) by 1108 days.

(21) Appl. No.: 11/312,009

(22) Filed: Dec. 19, 2005

(65) Prior Publication Data

US 2006/0133620 A1 Jun. 22, 2006

Related U.S. Application Data

(60) Provisional application No. 60/638,288, filed on Dec. 21, 2004.

(51) Int. Cl.
*H04R 3/00* (2006.01)

(52) U.S. Cl. ..... 381/96; 381/59; 381/94.9; 381/103

(58) Field of Classification Search ..... 381/59, 381/96, 66, 83, 93, 94.9, 103; 379/406.01, 379/406.08
See application file for complete search history.

(56) References Cited

U.S. PATENT DOCUMENTS 5,068,903 A 11/1991 Walker
5,542,001 A 7/1996 Reiffin
5,600,718 A * 2/1997 Dent et al. ..... 379/406.06
5,680,450 A * 10/1997 Dent et al. ..... 379/406.08
5,727,072 A * 3/1998 Raman ..... 381/94.2
6,408,079 B1 * 6/2002 Katayama et al. ..... 381/98
7,171,003 B1 * 1/2007 Venkatesh et al. ..... 381/66
7,359,519 B2 * 4/2008 Lee et al. ..... 381/59
7,492,217 B2 * 2/2009 Hansen et al. ..... 330/10

FOREIGN PATENT DOCUMENTS

WO WO 2005/120126 A1 12/2005

OTHER PUBLICATIONS

PCT Written Opionion for PCT/US2005/046582, mailed Jul. 5, 2007(8 Pages).
International Search Report dated Apr. 25, 2006. 4 pages.
Lashkari, K., "High Quality sound from small loudspeakers using the exact inverse", Signals, Systems and Computers, 2004. Asilomar Conference, CA. Nov. 2004.
Hyun Woo Kang, et al., "Adaptive Precompensation of Wiener Systems", IEEE Transactions on Signal Processing, vol. 46, No. 10, Oct. 1998.

* cited by examiner

*Primary Examiner*—Devona E Faulk
*Assistant Examiner*—Disler Paul
(74) *Attorney, Agent, or Firm*—Blakely, Sokoloff, Taylor & Zafman LLP

(57) ABSTRACT

A method and apparatus for loudspeaker equalization are described. In one embodiment, the method comprising generating a set of parameters using an invertible, non-linear system based on input audio data and output data corresponding to a prediction of an output of a loudspeaker in response to the input data, and controlling an exact non-linear inverse of the non-linear system using the set of parameters to output a predistorted version of the input data.

20 Claims, 7 Drawing Sheets

METHOD AND APPARATUS FOR FRAME-BASED LOUDSPEAKER EQUALIZATION

PRIORITY

The present patent application claims priority to the corresponding provisional patent application Ser. No. 60/638,288, titled, "Method and Apparatus for Frame-Based Loudspeaker Equalization", filed on Dec. 21, 2004, and incorporated herein by reference.

FIELD OF THE INVENTION

The field of the invention is precompensation for loudspeakers; more particularly, the present invention is related to frame-based equalization for loudspeakers.

BACKGROUND OF THE INVENTION

Future multimedia services such as videophones require high quality sound at high playback levels. Because of the size constraint, small loudspeakers in handsets introduce both linear and nonlinear distortions into the sound, especially at high sound volumes. Predistortion or equalization is a general technique for compensating for distortions of small loudspeakers. The existing equalization techniques compensate for distortions at low playback levels suitable for voice communication; at high playback levels needed for multimedia communication, they introduce more distortion.

U.S. patent application Ser. No. 11/145,411, entitled "Method and Apparatus for Loudspeaker Equalization Using Adaptive Feedback and Exact Inverse", (referred to hereinafter as "Lashkari") describes a method and an apparatus for loudspeaker equalization using adaptive feedback and an exact inverse. As described in Lashkari, the exact inverse improves the perceptual quality at high playback levels and performs much better than the conventional methods described in prior arts. However, the method described in Lashkari is not guaranteed to produce a stable inverse. A suboptimal heuristic method for stabilizing the exact inverse was described in Lashkari, which makes the exact inverse a pseudo-exact inverse.

U.S. Pat. No. 5,068,903, entitled "Method and Arrangement for Linearizing the Frequency Response of a Loudspeaker", issued Nov. 26, 1991 describes a method for equalizing the linear frequency response of the loudspeaker using impedance feedback. This patent describes equalizing the mechanical resonances arising from the loudspeaker, its enclosure or their combination. The impedance feedback is used to measure the loudspeaker's linear response and therefore no a priori measurement of the loudspeaker characteristics is necessary. Compensation of nonlinear distortion is not explicitly addressed in this patent.

U.S. Pat. No. 5,542,001, entitled "Smart Amplifier for Loudspeaker Motion Feedback Derived from Linearization of a Nonlinear Motion Responsive Signal", issued Jul. 30, 1996 describes a method for compensating the nonlinear distortion of a loudspeaker by deriving a feedback signal based on the back electromotive force (emf) that is proportional to the cone motion. The method described in this patent tries to compensate for the nonlinearity of the force factor BLi as a function of the voice coil displacement. Therefore, the force factor vs. displacement curves must be measured for each loudspeaker. Furthermore, this method also requires loudspeaker-specific tuning of the analog circuitry to approximate the correction factor.

U.S. Pat. No. 5,600,718, entitled "Apparatus and Method for Adaptively Precompensating for Loudspeaker Distortions", issued Feb. 4, 1997, uses the electrical equivalent circuit of an electrodynamic loudspeaker and output feedback to adjust the parameters of the precompensator over time. However, the loudspeaker model and the precompensator structure are completely different from the present invention. Also, the method uses an analog circuit to model the loudspeaker and fine tuning is required to match the circuit to the loudspeaker. A microphone is also needed to provide the feedback signal which is a drawback both in terms of the implementation and also because it picks up the background and ambient sounds that introduce errors into the precompensator adjustment procedure, especially in mobile applications where background noise is relatively high. The multipath echoes (or ring arounds) due to the acoustic environment are also a potential problem.

U.S. Pat. No. 6,408,079, entitled "Distortion Removal Apparatus, Method for Determining Coefficient for the Same, and Processing Speaker System, Multi-Processor, and Amplifier Including the Same", issued Jun. 18, 2002 describes a frame-based precompensator based on the second order Volterra inverse of a second order Volterra model of the loudspeaker in the frequency domain. The precompensator uses the Volterra model in the forward direction and the Volterra inverse for precompensation. In one embodiment, the predistortion filter uses the Volterra expansion to model the loudspeaker in the forward direction and then an invertible exact inverse for precompensation.

SUMMARY OF THE INVENTION

A method and apparatus for loudspeaker equalization are described. In one embodiment, the method comprising generating a set of parameters using an invertible, non-linear system based on input audio data and output data corresponding to a prediction of an output of a loudspeaker in response to the input data, and controlling an exact non-linear inverse of the non-linear system using the set of parameters to output a predistorted version of the input data.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
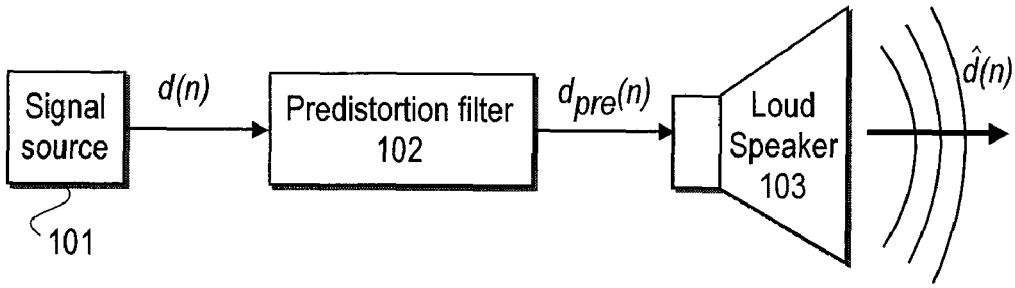
FIG. 1 illustrates one embodiment of the loudspeaker equalization system.

A method and an apparatus for improving the sound quality from small loudspeakers are described. Techniques are provided for compensating for a loudspeaker's distortions and enhancing the perceptual quality of the sound. The techniques disclosed include a frame-based method of compensating for distortions of small loudspeakers at high sound levels to improve the sound quality from these loudspeakers. In one embodiment, these techniques approximate the loudspeaker behavior over given time frames with an invertible nonlinear model, such as, for example, a Hammerstein or a Wiener model. In other words, in one embodiment, a stable exact nonlinear inverse is generated based on approximating the loudspeaker model with an exactly invertible nonlinear system such as a Hammerstein or a Wiener model over given time intervals. The approximate invertible model is then used to compute the predistorted signal over the frame and to drive the loudspeaker. The result is a stable exact predistortion filter that improves the perceptual quality. Thus, embodiments of the present invention combine the advantages of an exact nonlinear inverse with guaranteed stability.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; electrical, optical, acoustical or other form of propagated signals (e.g., carrier waves, infrared signals, digital signals, etc.); etc.

Overview

FIG. 1 illustrates one embodiment of an audio system. Referring to FIG. 1, an audio signal source 101 outputs a signal (d(n)). Predistortion filter 102 compensates for the linear and nonlinear distortions in the electro-acoustic conversion of the audio signal (d(n)). Predistortion filter 102 is also referred to herein as a precompensator, linearizer or an equalizer. The moving coil of loudspeaker 103 is driven by a prefiltered signal $d_{pre}(n)$ output from predistortion filter 102. The filtering is designed to be opposite to the loudspeaker's distortion, so that the actual displacement of the moving coil accurately matches the ideal motion prescribed by the original signal d(n). Ideally, the output of loudspeaker 103 when driven by predistorted signal $d_{pre}(n)$ is a close replica of the input signal d(n). In one embodiment, predistortion filter 102 acts as an adaptive precompensator by modifying its operation in response to the loudspeaker input and output signals.

Figure 2:
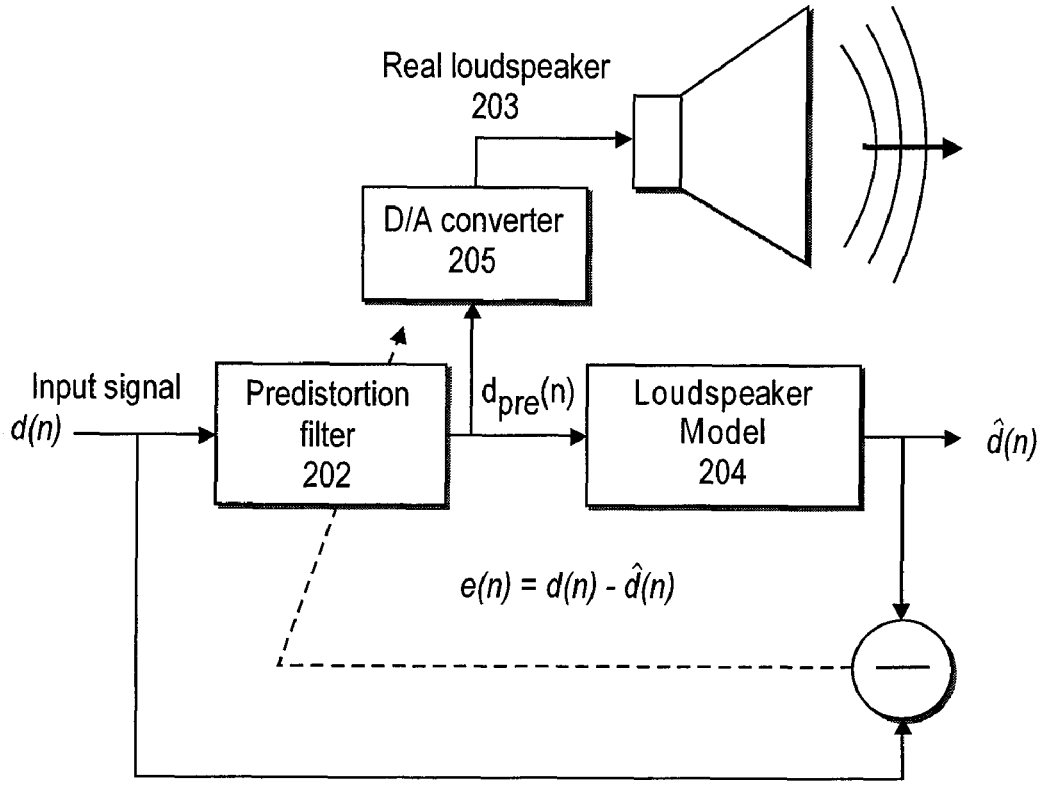
FIG. 2 illustrates the general idea of the exact inverse using concepts and notations of adaptive filtering theory.

FIG. 2 is a block diagram showing the general idea of the equalization using concepts and notations of adaptive filtering theory. Input signal d(n) is fed into a generally time-varying predistortion filter 202. The output of predistortion filter 201 is routed into a mathematical model 204 of loudspeaker 203 and also to a digital-to-analog converter 205 that drives loudspeaker 203. Mathematical model 204 of loudspeaker 203 predicts the next output of the loudspeaker ($\hat{d}(n)$).

This predicted output is used to derive a precompensation error signal ($e(n)=d(n)-\hat{d}(n)$), which is the difference between the ideal output d(n) and the predicted loudspeaker output $\hat{d}(n)$. The parameters of the predistortion filter are adjusted in such a way that the precompensation error e(n) is minimized or substantially reduced. In one embodiment, the mathematical model of the loudspeaker in general is a p-th order Volterra model as described in FIG. 5.

Figure 3:
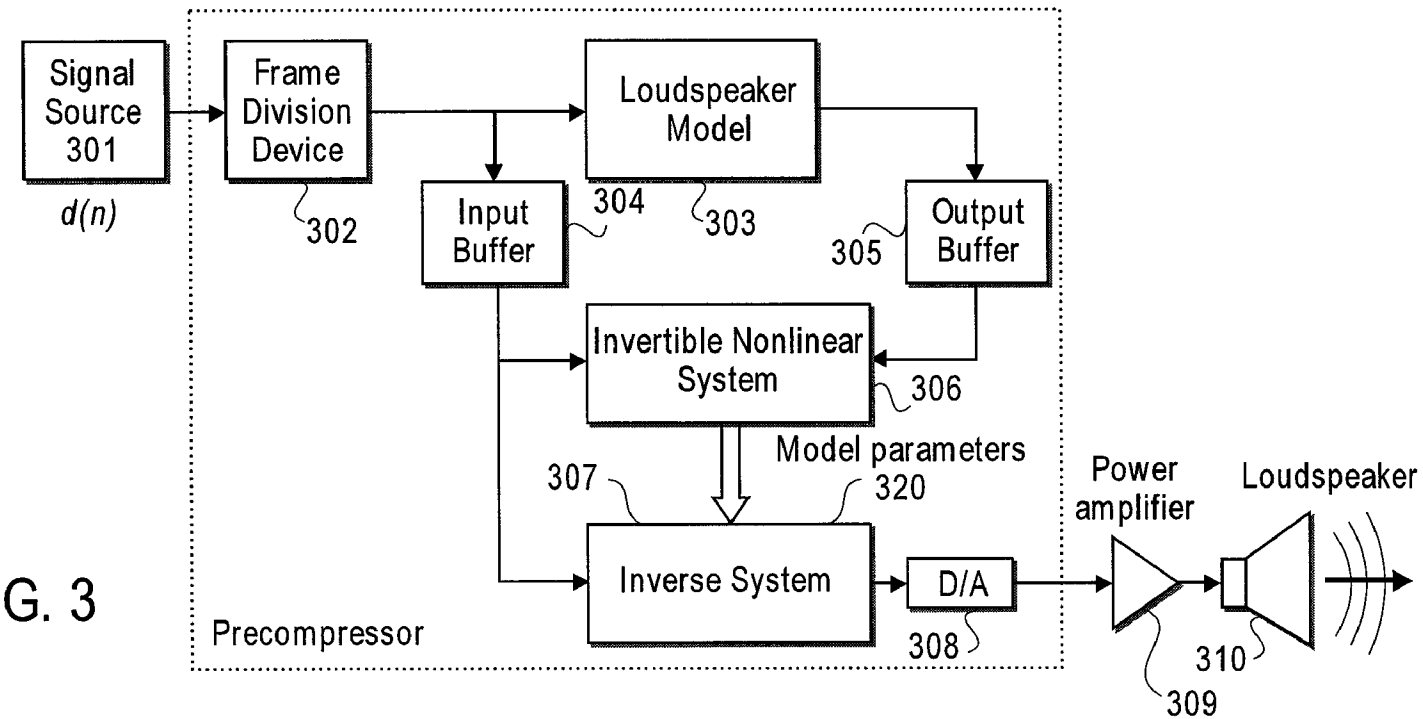
FIG. 3 is a block diagram of one embodiment of a predistortion filter scheme.

FIG. 3 is a block diagram of one embodiment of a predistortion filter scheme that uses adaptive precompensation by modifying the operation of a predistortion filter in response to the loudspeaker input and output signals. A local approximation to the loudspeaker model is computed over a short time frame using a stably invertible nonlinear system such as, for example, a Hammerstein or a Wiener system. The predistorted signal is computed by passing the input signal over a frame through inverse of the invertible nonlinear system. The predistorted signal is then rescaled and fed into the loudspeaker.

More specifically, the predistortion scheme generates a prediction of an output from a loudspeaker over a set of input data frames using a non-linear loudspeaker model. The prediction is used to approximate the non-linearity of a loudspeaker using another non-linear system that is invertible and stable by design. Using prediction and the input audio data, a set of parameters are generated using an invertible, non-linear system. These parameters are generated based on input audio data and output data corresponding to the prediction of an output of a loudspeaker in response to the input data. In one embodiment, the invertible non-linear system comprises a Hammerstein system. In another embodiment, the invertible non-linear system comprises a Wiener system.

Then the parameters control an exact non-linear inverse of the non-linear system, thereby causing it to output a predistorted version of the input data. More specifically, a predistortion signal is applied to each input data frame of the input audio signal using an inverse system that is an exact and stable inverse of the invertible non-linear system and that operates in response to the parameters from the invertible non-linear system. Thus, the scheme computes a predistorted version of an input audio signal based on results of approximating the non-linearity of the loudspeaker using the invertible and stable non-linear system.

Figure 4:
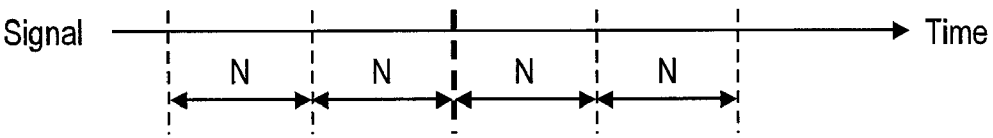
FIG. 4 shows an output of one embodiment of a frame division device.

Referring to FIG. 3, an input signal (d(n)) from a signal source 301 is fed into a frame division device 302 that divides the input signal into frames. FIG. 4 shows the output of one embodiment of frame division device 302. As shown, frame division device 302 takes the input signal and divides it into frames of fixed lengths. In one embodiment, each of the fixed frames are of 20-30 ms in length.

Figure 5:
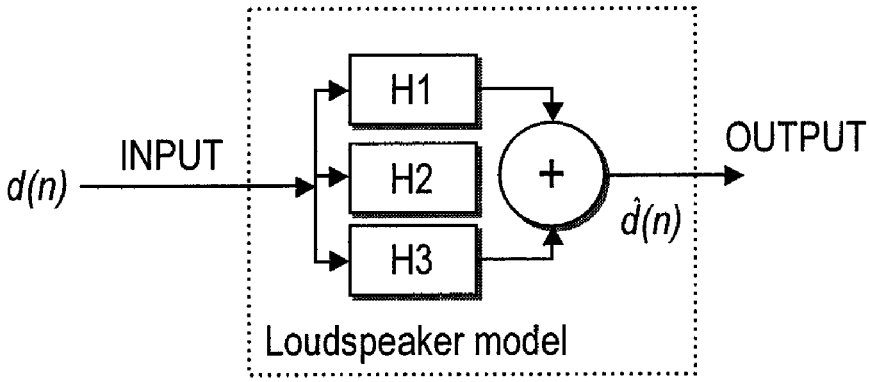
FIG. 5 illustrates one embodiment of the loudspeaker model using a third order Volterra expansion.

Referring back to FIG. 3, loudspeaker model 303 receives the output of frame division device 302 and predicts the loudspeaker output for the input frame data. In one embodiment, loudspeaker model 303 is a Volterra model. FIG. 5 illustrates one embodiment of a loudspeaker model using a third order Volterra expansion in which each of the terms of the expansion are added together using an adder in a manner well-known in the art. Note that any model that could closely predict the output of the loudspeaker could be used. For example, a physical model based on the Small-Thiele parameters or electrical circuits simulating electrodynamic loudspeakers could be used. Output buffer 305 stores the predicted output of loudspeaker from loudspeaker model 303.

Input buffer 304 receives the output of frame division device 302 as well and stores the frame data. Invertible nonlinear system module 306 receives the contents of input buffer 304 and output buffer 305. In response to these inputs, invertible nonlinear system module 306 computes parameters 320 of a stable and invertible nonlinear system. Once the system has been identified, inverse system 307 uses parameters 320 to compute the exact nonlinear inverse of the system. The nonlinear system is by design invertible and stable, so that its inverse is guaranteed to exist and be stable. Once the inverse system is computed, the frame data stored in the input buffer is run through the inverse system to produce the predistorted signal $d_{pre}(n)$.

A digital-to-analog converter (D/A) 308 converts the digital predistorted signal into an analog signal. Power amplifier 309 receives the analog signal and drives loudspeaker 310.

Figure 6:
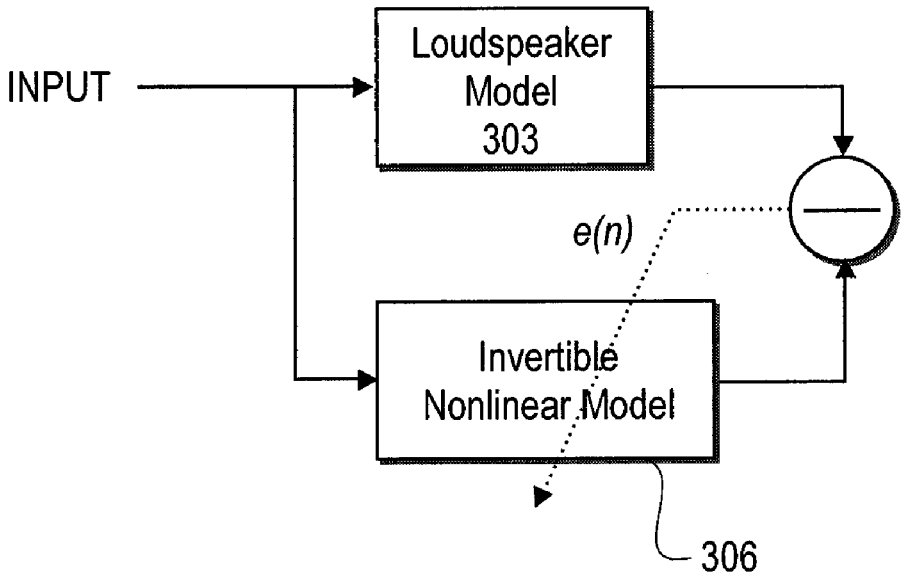
FIG. 6 is a data flow diagram illustrating computation of one embodiment of the nonlinear invertible system.

FIG. 6 is a data flow diagram illustrating computation of one embodiment of the nonlinear invertible system. Referring to FIG. 6, loudspeaker model 303 receives a frame of input audio to predict the next output of the loudspeaker. Invertible nonlinear system 306 includes an invertible non-linear model whose structure is known in advance (e.g., a Hammerstein, a Wiener model, a Volterra-Wiener model, a Volterra-Hammerstein model, etc.). The output of loudspeaker model 303 and the invertible nonlinear model of invertible nonlinear system 306 are compared to each other to determine their difference. The difference, referred to as modeling error e(n) represents the error in modeling the loudspeaker model 303. The parameters of the nonlinear system are then adjusted so as to minimize the modeling error e(n). Such minimization maybe performed using well-known methods such as, for example, but not limited to the LMS or the RLS algorithms or the gradient descent algorithm. This may also be done using closed form solutions.

Figure 7:
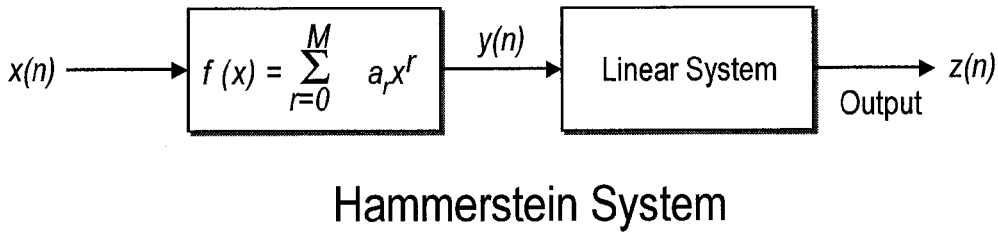
FIG. 7 illustrates an embodiment for the invertible nonlinear model showing a Hammerstein system consisting of a memoryless polynomial nonlinearity followed by a linear system.

FIG. 7 illustrates one embodiment for the invertible nonlinear model using a Hammerstein system consisting of a memoryless polynomial nonlinearity followed by a linear system. The linear system could be a pole-zero system specified by the transfer function B(z)/A(z) or a finite impulse response (FIR) filter.

Figure 8:
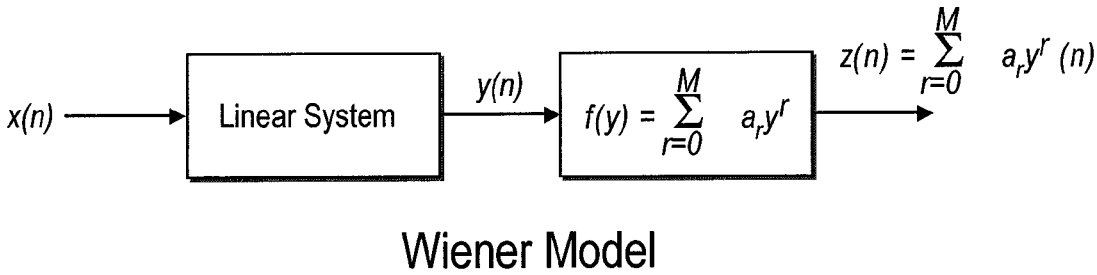
FIG. 8 illustrates an embodiment for the invertible nonlinear model showing a Wiener system consisting of a linear system followed by a memoryless polynomial nonlinearity.

FIG. 8 illustrates one embodiment for the invertible nonlinear model using a Wiener system consisting of a linear system followed by a memoryless polynomial nonlinearity. The linear system could a pole-zero system specified by the transfer function B(z)/A(z) or a finite impulse response (FIR) filter.

Any nonlinear system with a stable inverse can be used including systems based on physical model of the loudspeaker. Both the Hammerstein and the Wiener systems are invertible and the inverse can be found in a stable manner.

Figure 9:
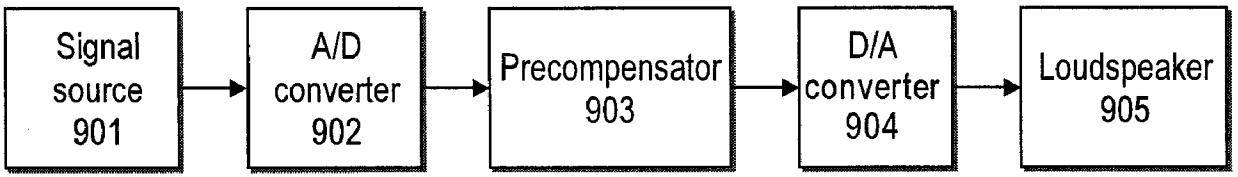
FIG. 9 illustrates an embodiment where the signal source is an analog source.

FIG. 9 is a block diagram of an embodiment of a loudspeaker equalization system in which the signal source is an analog source. Referring to FIG. 9, signal source 901 outputs an analog signal. An analog-to-digital converter (A/D) 902 converts the analog signal to digital. Precompensator 903 receives the digital output from A/D converter 902. Precompensator 903 produces a predistorted signal that when passed through the loudspeaker compensates for the linear and nonlinear distortions. The digital output of precompensator 903 is fed into a digital-to-analog (D/A) converter 904, which converts it to analog. The analog output of D/A converter 904 drives loudspeaker 905.

Figure 10:
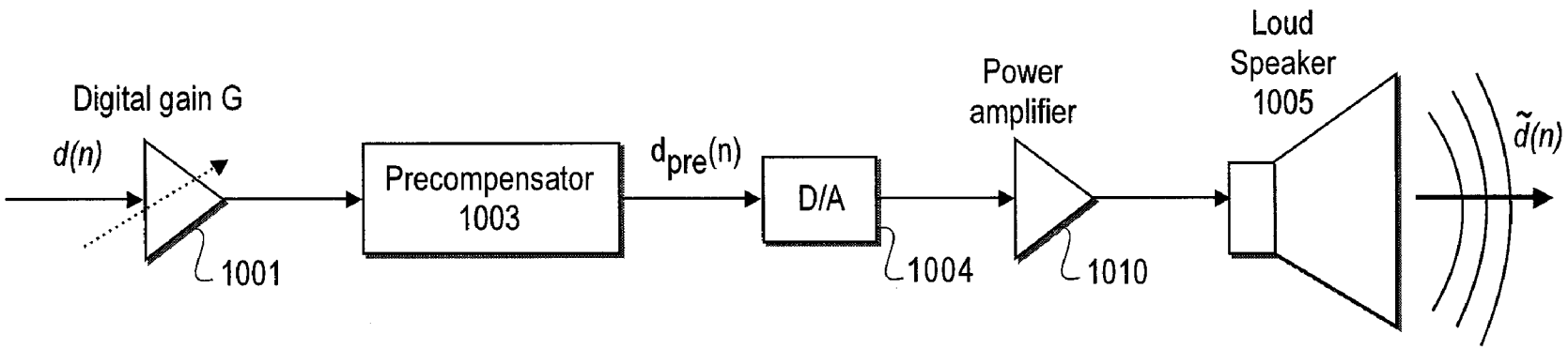
FIG. 10 is a block diagram of an alternate embodiment of a loudspeaker equalization system.

FIG. 10 is a block diagram of an alternate embodiment of a loudspeaker equalization system. Referring to FIG. 10, a variable digital gain module 1001 adjusts the level of a digitalized input signal. That is, the sound level of the loudspeaker is controlled by digital gain module 1001 before precompensation. Precompensator 1003 is a digital precompensator and performs the precompensation described above. Digital-to-analog (D/A) converter 1004 receives the output of precompensator 1003 and converts the digital signal to analog. A fixed gain power amplifier 1010 drives loudspeaker 1005 in response to the analog signal from power amplifier 1010.

Figure 11:
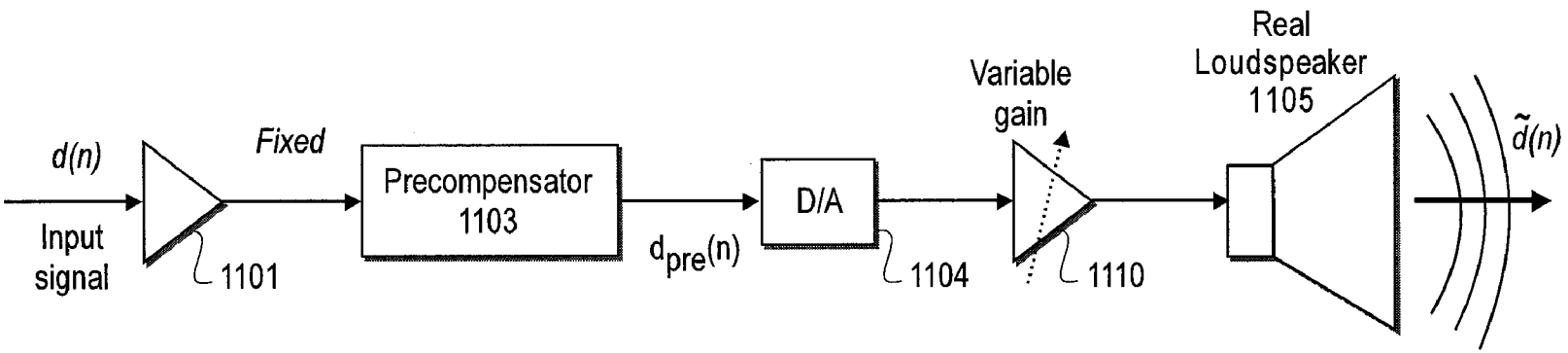
FIG. 11 is a block diagram of another alternate embodiment of a loudspeaker equalization system.

FIG. 11 is a block diagram of another alternate embodiment of a loudspeaker equalization system. In this embodiment, the sound level from the loudspeaker is controlled by the variable analog gain of a power amplifier before the loudspeaker.

Referring to FIG. 11, a digital input signal d(n) is altered by a fixed gain device 1101. Precompensator 1103 receives the output of gain device 1101 and performs the precompensation described above. Digital-to-analog (D/A) converter 1104 receives the output of precompensator 1103, $d_{pre}(n)$, and converts it into an analog signal. The analog signal from D/A converter 1104 is input into a variable gain power amplifier 1110. In response thereto, variable gain power amplifier 1110 drives loudspeaker 1105. Thus, variable gain amplifier 1110 controls the sound level of loudspeaker 1105.

Figure 12:
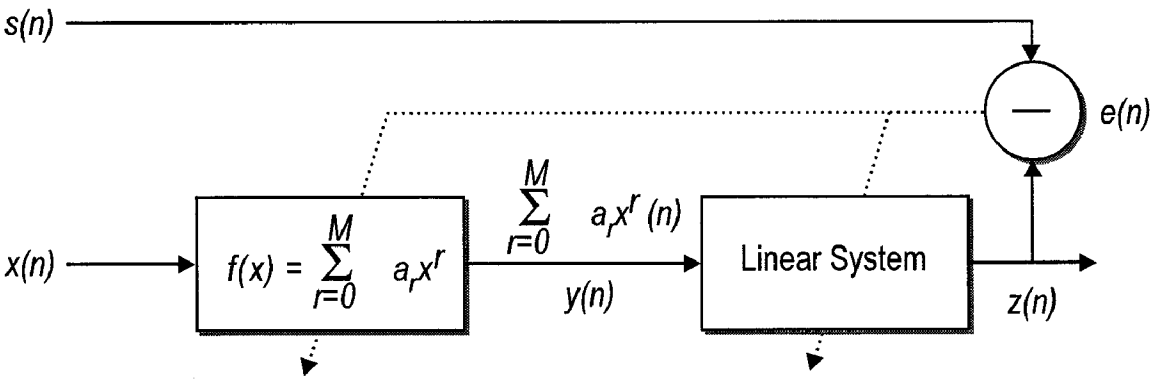
FIG. 12 illustrates the derivation of the Hammerstein model.

In one embodiment, the parameters of the Hammerstein model can be derived using a gradient descent method described here. FIG. 12 illustrates the derivation of the Hammerstein model. More specifically, the Hammerstein model is specified by M+1 polynomial coefficients $\{a_0, a_1, \ldots a_M\}$ and the parameters of the linear system. In this derivation, the linear system is assumed to be given by an FIR impulse response of length L given by $H_1=\{h_1(0), h_1(1), \ldots h_1(L-1)\}$. The parameters of the Hammerstein model are adjusted to minimize the error e(n) between the desired signal s(n) and the output of the Hammerstein model z(n). The signal at various stages of the Hammerstein model can be expressed as:

$$y(n) = \sum_{r=0}^{M} a_r x^r(n) \tag{1}$$

$$z(n) = \sum_{l=0}^{L-1} h_1(l) y(n-l) \tag{2a}$$

$$z(n) = \sum_{l=0}^{L-1} h_1(l) \sum_{r=0}^{M} a_r x^r(n-l) = \sum_{r=0}^{M} \sum_{l=0}^{L-1} a_r h_1(l) x^r(n-l) \tag{2b}$$

The error e(n) is given by:

$$e(n)=s(n)-z(n) \tag{3a}$$

and the total error over a frame of length N is given by:

$$E = \sum_{n=0}^{N-1} e^2(n) \tag{3b}$$

From equation (3b), the gradient is given as:

$$\nabla E = 2\sum_{n=0}^{N-1} e(n) \nabla e(n) \tag{4}$$

From equation (3a), we have:

$$\nabla e(n) = -\nabla z(n) = -\left[\frac{\partial z(n)}{\partial a_0}, \frac{\partial z(n)}{\partial a_1}, \cdots \frac{\partial z(n)}{\partial a_M}, \frac{\partial z(n)}{\partial h_1(0)}, \cdots \frac{\partial z(n)}{\partial h_1(L-1)}\right] \tag{5}$$

From equation (2a), we get:

$$\frac{\partial z(n)}{\partial a_i} = \sum_{l=0}^{L-1} h_1(l) \frac{\partial y(n-l)}{\partial a_i} \tag{6a}$$

From equation (1), we can write:

$$\frac{\partial y(n-l)}{\partial a_i} = x^i(n-l) \tag{6b}$$

Putting equations (6a) and (6b) together, we get:

$$\frac{\partial z(n)}{\partial a_i} = \sum_{l=0}^{L-1} h_1(l) x^i(n-l) \tag{6c}$$

Similarly from equation (2a), we can write:

$$\frac{\partial z(n)}{\partial h_1(j)} = y(n-j) \tag{7}$$

Let:

$$P=[p_0, p_2, \ldots P_{M+L}]=[a_0, a_1, \ldots a_M, h_1(0), h_1(2), \ldots h_1(L-1)] \tag{8}$$

be the L+M+1 dimensional vector of model parameters. Then starting from an initial guess $P_0$ and using the gradient descent algorithm with a step size μ, the parameter vector $P^{(k)}$ at iteration k can be updated as:

$$P^{(k)}=P^{(k-1)}+\mu\nabla E \tag{9}$$

where the gradient vector can be computed by substituting partial derivatives from equations (6c) and (7) into (5) and then equations (5) into (4). The algorithm continues until some termination criterion is met such as a predetermined number of iterations is reached or the total error E is below some predetermined value. The Wiener system can also be derived in a similar fashion.

Figure 13:
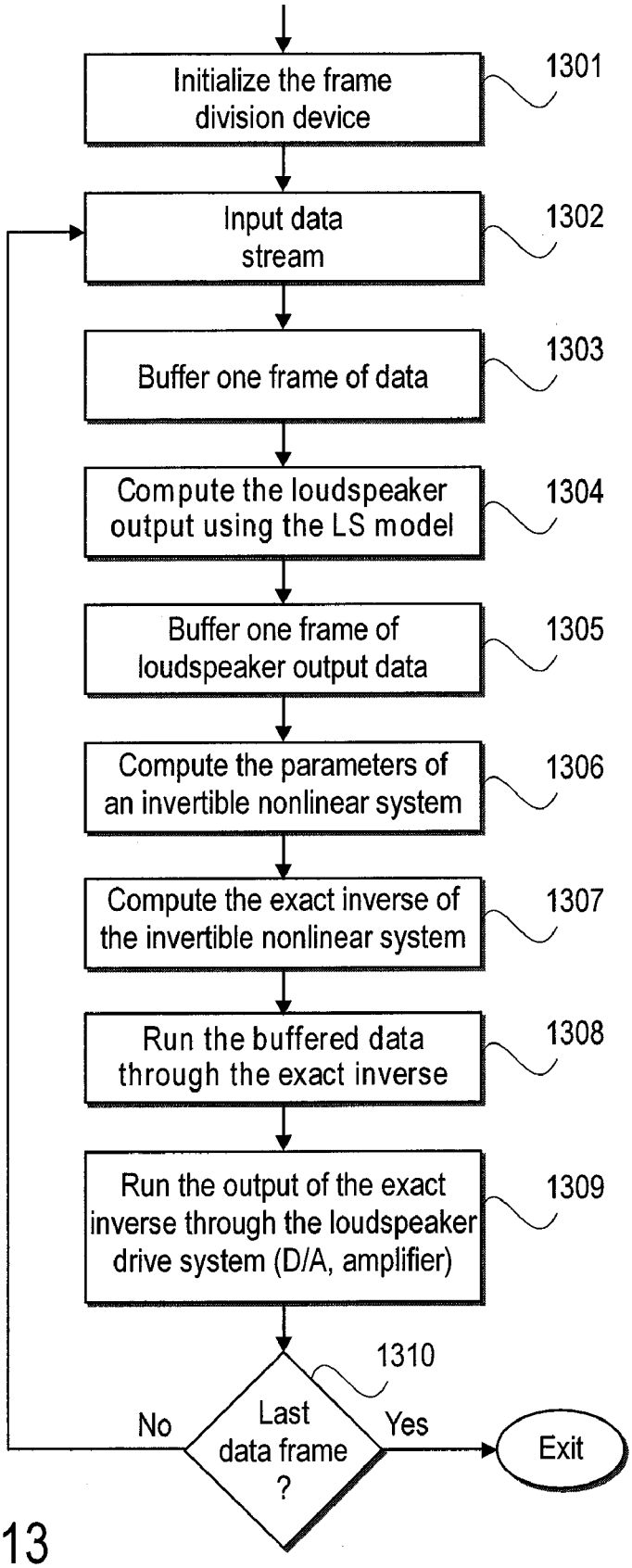
FIG. 13 is a flow diagram of a process for performing the precompensation.

FIG. 13 is a flow diagram of a process for performing precompensation. The process is performed by processing logic that may comprise hardware (e.g., circuitry, dedicated logic, etc.), software (such as is run on a general purpose computer system or a dedicated machine), or a combination of both.

Referring to FIG. 13, the process begins by processing logic initializing the frame division device (processing block 1301). In one embodiment, the initialization consists of specifying a parameter representing the frame length and initializing the device buffers and frame counter to zero.

After initialization, processing logic receives the input data stream (processing block 1302). Upon receipt, processing logic stores the digitized input signal one frame at a time in an input buffer (processing block 1303) and also feds the digitized input signal into the loudspeaker.

In response to the digitized input signal, processing logic computes (or predicts) the loudspeaker output using a mathematical model of the loudspeaker (processing logic 1304). The mathematical model could be a $2^{nd}$ order, $3^{rd}$ order or a higher order Volterra model or it could be a physical model such as, for example, but not limited to, the Small-Thiele model or any other suitable model. Processing logic buffers one frame of the loudspeaker output data (processing block 1305).

Then processing logic computes the parameters of an invertible nonlinear system (processing logic 1306). In one embodiment, the parameters of the invertible nonlinear system are computed using a frame of loudspeaker input and its predicted output. In one embodiment, the invertible nonlinear system is a nonlinear system that is generally simpler than the Volterra model such as, for example, the Hammerstein or the Wiener model. Notable, the invertible system and its inverse are stable.

In one embodiment, processing logic computes the parameters of the Hammerstein model using a gradient descent algorithm as described above. Other methods such as, for example, the LMS (Least Mean Squares) or RLS (Recursive Least Squares) algorithms or polynomial fitting procedures can also be used. Also other simplifying assumptions could be made. The parameters of the invertible nonlinear system are computed so as to reduce, and potentially minimize, the mean square error between the outputs of the loudspeaker and the invertible system. This method gives an invertible nonlinear system that is as close as possible to the loudspeaker model in the mean square sense.

Once the parameters of the invertible nonlinear system are computed, processing logic computes the exact inverse of the invertible nonlinear system (processing block 1307).

Next, processing logic runs the signal stored in the input buffer through the exact inverse to compute the predistorted signal (processing block 1308) and feeds the digitized predistorted signal into the loudspeaker drive system (processing block 1309). In one embodiment, the loudspeaker drive system consists of a digital-to-analog converter (D/A) and a speaker amplifier. The digitized predistorted signal is fed into the D/A to develop an analog predistorted signal. The analog predistorted signal drives a loudspeaker amplifier that controls the level of the drive signal into the loudspeaker. This signal level is controlled in order to prevent the loudspeaker from being damaged and also to prevent hard limiting by the loudspeaker amplifier.

Once the frame data is processed, processing logic tests whether the last data frame has been processed (processing block 1310). If not, the process transitions to processing block 1302 and the process repeats. If it is, the process ends.

In one embodiment, processing logic increments the frame counter in the frame division device by one and recomputes and updates the contents of the input and output buffers and parameters of the invertible nonlinear system and its inverse to repeat the processing. Also, processing logic generates a new frame of predistorted signal and feeds it to the loudspeaker.

The frame-based processing described herein introduces a delay of one frame. For communication applications, the frame size must be selected to satisfy the requirements of the communication.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

I claim:

1. A method, implemented by a computing device programmed to perform operations, comprising:

receiving input audio data at a predistortion filter comprising an invertible, non-linear system, a loudspeaker model, and an exact non-linear inverse of the invertible, non-linear system;

predicting an output of a loudspeaker in response to the input data using the loudspeaker model without feedback of an actual output of the loudspeaker;

generating a set of parameters using the invertible, non-linear system using the input audio data and the predicted output; and controlling the exact non-linear inverse of the non-linear system using the set of parameters to output a predistorted version of the input data.

2. The method defined in claim 1 further comprising approximating non-linearity of the loudspeaker using another non-linear system that is invertible and stable.

3. The method defined in claim 2 further comprising computing the predistorted version of input data based on results of approximating the non-linearity of the loudspeaker using the other invertible and stable non-linear system.

4. A method comprising:

predicting an output from a loudspeaker over one or more input data frames in response to one or more input data frames of an input audio signal and without feedback of an actual output of the loudspeaker, the predicted output of a non-linear loudspeaker model being in the form of one or more predicted output data frames;

calculating parameters in response to each input data frame and its corresponding predicted output data frame from a loudspeaker model; and apply a predistortion signal to each input data frame of the input audio signal to produce a predistorted version of the input data frame using an inverse system that is an exact and stable inverse of a invertible non-linear system and that operates in response to the parameters from the invertible non-linear system; and producing an audio output with the loudspeaker in response to the predistorted versions of the input data frames.

5. The method defined in claim 4 wherein the invertible non-linear system comprises a Hammerstein system.

6. The method defined in claim 4 wherein the invertible non-linear system comprises a Wiener system.

7. A precompensator comprising:

a loudspeaker model to predict one or more output data frames from a loudspeaker using a non-linear loudspeaker model in response to one or more input data frames of an input audio signal and without feedback of an actual output of the loudspeaker;

an invertible non-linear system to receive the input data frames and the predicted output data frames to calculate parameters in response to each input data frame and its corresponding output data frame received from the loudspeaker model; and an inverse system responsive to the parameters from the invertible non-linear system to output a predistorted signal in response to each frame of the input audio signal.

8. The precompensator defined in claim 7 wherein the loudspeaker model is non-linear.

9. The precompensator defined in claim 7 wherein the invertible non-linear system comprises a Hammerstein system.

10. The precompensator defined in claim 7 wherein the invertible non-linear system comprises a Wiener system.

11. The precompensator defined in claim 7 further comprising:

a frame division unit to divide the input audio signal into the one or more input data frames.

12. The precompensator defined in claim 7 wherein the inverse system is an exact and stable inverse of the invertible non-linear system.

13. The precompensator defined in claim 7 wherein the inverse system applies a predistortion signal in response to each input data frame of the input audio signal.

14. An audio processing system comprising:

a frame division unit to divide an input audio signal into one or more input data frames;

a non-linear loudspeaker model to predict an output from a loudspeaker over each of the one or more input data frames in response to one or more input data frames and without feedback of an actual output of the loudspeaker, the predicted output of the non-linear loudspeaker model being in the form of one or more predicted output data frames;

an invertible non-linear system to receive the input data frames from the frame division unit and the predicted output data frames from the non-linear loudspeaker model and to calculate parameters in response to each input data frame and its corresponding output data frame from the loudspeaker model; and an inverse system that is an exact and stable inverse of the invertible non-linear system, the inverse system being responsive to the parameters from the invertible non-linear system to apply predistortion signal in response to each input data frame of the input audio signal.

15. The system defined in claim 14 wherein the invertible non-linear system comprises a Hammerstein system.

16. The system defined in claim 14 wherein the invertible non-linear system comprises a Wiener system.

17. The system defined in claim 14 further comprising the loudspeaker.

18. The system defined in claim 14 further comprising a digital-to-analog converter to receive the output of the inverse system and convert the output to an analog signal.

19. The system defined in claim 18 further comprising a power amplifier coupled to receive the analog signal and drive the loudspeaker in response thereto.

20. The system defined in claim 14 further comprising an analog-to-digital converter to digitize an analog input signal into a digitized version of the input signal, the digitized version of the input signal being the input audio signal.

* * * * *